US005657644A

United States Patent [19]

Oakey et al.

[11] Patent Number: 5,657,644

[45] Date of Patent: Aug. 19, 1997

[54] AIR SEPARATION

[75] Inventors: John Douglas Oakey, Godalming; Paul Higginbotham, Guildford, both of England

[73] Assignee: The BOC Group plc, Windlesham, England

[21] Appl. No.: 619,023

[22] Filed: Mar. 20, 1996

[30] Foreign Application Priority Data

Mar. 21, 1995 [GB] United Kingdom ..... 9505645

[51] Int. Cl.[6] ..... F25J 3/04

[52] U.S. Cl. ..... 62/652; 62/924

[58] Field of Search ..... 62/652, 924

[56] References Cited

U.S. PATENT DOCUMENTS

| | | | |
|---|---|---|---|
| 4,533,375 | 8/1985 | Erickson | 62/924 X |
| 4,817,394 | 4/1989 | Erickson | 62/924 X |
| 4,842,625 | 6/1989 | Allam et al. | 62/924 X |
| 5,572,874 | 11/1996 | Rathbone | 62/645 |
| 5,582,031 | 12/1996 | Rathbone | 62/924 X |

*Primary Examiner*—Christopher Kilner
*Attorney, Agent, or Firm*—David M. Rosenblum; Salvatore P. Pace

[57] ABSTRACT

A stream of precooled and purified air is introduced into a double rectification column comprising a higher pressure rectification column and a lower pressure rectification column and is separated therein into an oxygen-rich fraction and a nitrogen-rich fraction. A stream of argon-enriched oxygen vapour flows from the lower pressure rectification column into a side column in which argon is separated therefrom. An oxygen-enriched liquid air stream is taken from the bottom of the higher pressure rectification column. A vaporous oxygen-enriched air stream is introduced into the lower pressure rectification column above the point at which argon-enriched oxygen vapour is removed. At least part of the oxygen-enriched liquid is partially reboiled in a reboiler and is separated in a further rectification column, thereby to form a vapour depleted of oxygen and a liquid air stream further enriched in oxygen. At least one stream of the further-enriched liquid is vaporised to form the oxygen-enriched vapour that is introduced into the lower pressure rectification column. A part of the oxygen-depleted vapour is condensed and is taken as product or reintroduced into the lower pressure rectification column. The partial reboiling in the reboiler is effected by indirect heat exchange with a stream of argon-enriched oxygen vapour withdrawn from the outlet, or in an alternative process with a stream withdrawn from an intermediate region of the side column.

22 Claims, 6 Drawing Sheets

AIR SEPARATION

BACKGROUND OF THE INVENTION

This invention relates to a process and plant for separating air.

The most important method commercially for separating air is by rectification. In such a method there are typically performed steps of compressing and purifying the air, fractionating the compressed, purified, air in the higher pressure column of a double rectification column comprising a higher pressure rectification column and a lower pressure rectification column. Condensing, by indirect heat exchange with oxygen-rich fluid separated in the lower pressure column, nitrogen vapour separated in the higher pressure rectification column, employing a first stream of a resulting condensate as reflux in the higher pressure rectification column and a second stream of the resulting condensate as reflux in the lower pressure rectification column, withdrawing an oxygen-enriched liquid air stream from the higher pressure rectification column, and introducing an oxygen-enriched vaporous air stream to the lower pressure rectification column, and separating the oxygen-enriched vaporous air stream therein into oxygen-rich and nitrogen-rich fractions.

The purification of the air is performed so as to remove impurities of relatively low volatility, particularly water vapour and carbon dioxide. If desired, hydrocarbons may also be removed.

At least a part of the oxygen-enriched liquid air which is withdrawn from the higher pressure rectification column is typically completely vaporised so as to form the vaporous oxygen-enriched air stream which is introduced into the lower pressure rectification column.

A local maximum concentration of argon is created at an intermediate level of the lower pressure rectification column beneath the level at which the vaporous oxygen-enriched air stream is introduced. If it is desired to produce an argon product, a stream of argon-enriched oxygen vapour is taken from a vicinity of the lower pressure rectification column below the oxygen-enriched vaporous air inlet where the argon concentration is typically in the range of 5 to 15% by volume and is introduced into a bottom region of a side rectification column in which an argon product is separated therefrom. Reflux of the side column is provided by a condenser at the head of the column. The condenser is cooled by a part or all of the oxygen-enriched liquid air withdrawn from the higher pressure rectification column, the oxygen-enriched liquid air thereby being vaporised. Such a process is, for example, illustrated in EP-A-377 117.

The deployment of a side rectification column to separate an argon product from the air tends to add to the thermodynamic inefficiency of the lower pressure rectification column. Not only does this added inefficiency tend to increase the overall power consumption of the process, it may also cause there to be a reduction in the recovery (i.e. yield) of one or both of the argon and oxygen products in certain circumstances. These circumstances include those in which the rectification columns are required to separate a second liquid feed air stream in addition to the first vaporous feed air stream. Such a second liquid air stream is required when an oxygen product is withdrawn from the lower pressure rectification column in liquid state, is pressurised, and is vaporised by heat exchange with incoming air so as to form an elevated pressure oxygen product in gaseous state. A liquid air feed is also typically employed in the event that one or both of the oxygen and nitrogen products of the lower pressure rectification column are taken in liquid state.

It is an aim of the present invention to provide a method and plant that enable the aforesaid problems, or at least one of them, to be ameliorated.

SUMMARY OF THE INVENTION

According to the present invention there is provided an air separation process including using a double rectification column comprising a higher pressure rectification column and a lower pressure rectification column to separate a flow of compressed air into an oxygen-rich fraction and a nitrogen-rich fraction, and a side rectification column to separate an argon fraction from an argon-enriched oxygen vapour stream withdrawn from an intermediate outlet of the lower pressure rectification column, wherein an oxygen-enriched liquid air stream is taken from the higher pressure rectification column, and a vaporous oxygen-enriched air stream is introduced into the lower pressure rectification column through an inlet above the said intermediate outlet, characterised in that at least part of said oxygen-enriched liquid air stream is both partially reboiled and separated at a pressure between the pressure at the bottom of the higher pressure rectification column and that at the said inlet to the lower pressure rectification column, thereby forming a liquid air stream further enriched in oxygen and a vapour depleted of oxygen, said partial reboiling is effected by indirect exchange with a stream of vapour withdrawn from a section of the lower pressure rectification column extending from said intermediate outlet to said inlet or withdrawn from an intermediate region of the side rectification column, at least one stream of the further enriched liquid is vaporised so as to form part or all of the said vaporous oxygen-enriched air stream, a flow of the oxygen-depleted vapour is condensed, and at least part of the condensed oxygen-depleted vapour is introduced into the lower pressure rectification column or is taken as product, the flow of the vapour depleted of oxygen being condensed by indirect heat exchange with a stream of the further enriched liquid if the partial reboiling is effected by indirect heat exchange with a stream of vapour withdrawn from an intermediate region of the side rectification column.

The invention also provides an air separation plant including a double rectification column comprising a higher pressure rectification column and a lower pressure rectification column for separating a flow of compressed air into an oxygen-rich fraction and a nitrogen-rich fraction, and a side rectification column for separating an argon-enriched oxygen vapour stream withdrawn from an intermediate outlet of the lower pressure rectification column, wherein the higher pressure rectification column has an outlet for an oxygen-enriched liquid air stream and the lower pressure rectification column has an inlet for an oxygen-enriched vaporous air stream above said intermediate outlet, characterised in that the plant additionally includes a reboiler for partially reboiling and a vessel for separating at least part of said oxygen-enriched liquid air stream at a pressure between the pressure at the bottom of the higher pressure rectification and that at the said inlet to the lower pressure rectification column, whereby, in use, a liquid air stream further enriched in oxygen and a vapour depleted of oxygen are formed; a heat exchanger for vaporising a stream of the further enriched liquid air so as to form a part or all of the vaporous oxygen-enriched air feed to the lower pressure rectification column, and a condenser for condensing a stream of the oxygen-depleted vapour having an outlet for condensate communicating with a further inlet to the lower pressure rectification column or with a product collection vessel; and the reboiler has heat exchange passages communicating with an outlet from a section of the lower pressure rectification column extending from said intermediate inlet to said outlet for the argon-enriched oxygen vapour or with an outlet from an intermediate region of the side rectification column, the condenser having heat exchange passages for the flow therethrough of a stream of the further enriched liquid if the reboiler has heat exchange passages communicating with an outlet from an intermediate region of the side rectification column.

The process and plant according to the invention make it possible in comparison with a comparable conventional process and plant to reduce the total power consumption, to increase the argon yield, and to increase the yield of oxygen-rich fraction. The degree of improvement tends to be greater in processes and plant in which the higher pressure rectification column receives a part of the flow of compressed air in liquid state. The ability of the process and plant according to the present invention to achieve these advantages is dependant upon the partial reboiling of the oxygen-enriched liquid air stream and its separation to form the oxygen-depleted vapour, and the condensation of this vapour to form a liquid which can be employed to provide a reflux ratio in the said section of the lower pressure rectification column higher than the equivalent ratio in a comparable conventional process and plant.

Normally the condensed oxygen-depleted vapour is introduced into the lower pressure rectification column. If in an example of the process and plant according to the invention, however, the oxygen-depleted vapour is nitrogen of a product purity, the condensed oxygen-depleted vapour can be taken directly as product in preference to a part of the nitrogen vapour that is typically formed at the top of the higher pressure rectification column. Accordingly, in such an example, a greater proportion of the nitrogen vapour separated in the higher pressure rectification column can, downstream of its condensation, be employed as reflux in the lower pressure rectification column. Thus, even in this example, the reflux ratio in the section of the lower pressure rectification column extending from the intermediate outlet for argon-enriched oxygen vapour and the inlet for oxygen-enriched air vapour can be increased.

The term "rectification column", as used herein, means a distillation or fractionation column, zone or zones, i.e. a contacting column, zone or zones wherein liquid and vapour phases are countercurrently contacted to effect separation of a fluid mixture, as for example, by contacting of the vapour and liquid phases on packing elements or on a series of vertically spaced trays or plates mounted within the column, zone or zones. A rectification column may comprise a plurality of zones in separate vessels if, for example, in the event all the trays, plates or packing were to be contained within a single vessel, the resulting height of the rectification column could be undesirably great. For example, it is known to include a height of packing amounting to 200 theoretical plates in an argon rectification column. If all this packing were included in a single vessel, the vessel may typically have a height of over 50 meters. It is therefore desirable to construct the argon rectification column in two separate vessels so as to avoid having to employ a single, exceptionally tall, vessel.

Preferably, the said stream of vapour which is indirectly heat exchanged with said part of the oxygen-enriched liquid air stream has the same composition as the argon-enriched oxygen vapour stream, and is therefore taken from the bottom of the section extending from the intermediate outlet for the argon-enriched oxygen vapour stream to the inlet for the vaporous oxygen-enriched air stream. The construction of the plant is therefore simpler than were the heat exchange stream to be taken from an intermediate location within the said section, and generally enables more convenient temperature differences to be obtained in the reboiler of the oxygen-enriched liquid air stream and the condenser a the oxygen-depleted vapour. There are also, however, advantages in taking the heat exchange stream from an intermediate region of the said section, in that the size of this stream would be potentially larger.

Preferably, the entire oxygen-enriched liquid air stream is partially reboiled. The oxygen-enriched liquid air stream is preferably sub-cooled upstream of its heat exchange with the stream of vapour withdrawn from said section of the lower pressure rectification column.

The oxygen-enriched liquid air stream may be partially reboiled upstream of a vessel in which the separation of the further-enriched liquid from the oxygen-depleted vapour is performed. Alternatively, the reboiler in which this reboiling is performed may be located with the vessel. The vessel in which the further-enriched liquid is separated from the oxygen-depleted vapour may simply be a phase separator. In such examples of the process and plant according to the invention, the oxygen-depleted vapour still contains some oxygen and is not nitrogen of product purity. It is therefore preferred that the vessel in which the separation of the further-enriched liquid from the oxygen-depleted vapour is conducted is itself another rectification column having sufficient liquid-vapour contact elements (e.g. trays, plates or packing) to enable nitrogen of product purity to be produced.

Preferably, a stream of the further-enriched liquid is reduced in pressure, for example by passage through a throttling valve, and is indirectly heat exchanged with the oxygen-depleted vapour in order to condense that vapour. A part of the condensate is returned to the vessel in which the separation of the oxygen-depleted vapour from the further-enriched liquid is performed in the event that such vessel forms another rectification column. Reflux is thereby provided for this rectification column.

Another stream of further-enriched liquid is preferably reduced in pressure and employed to condense the argon-rich vapour. The condensing temperature of the argon-rich vapour is set by the pressure at the top of the side column and the composition of the argon-rich vapour. If the further-enriched liquid is employed to condense the argon-rich vapour, the pressure at the top of the side column needs to be selected so as to ensure that there is an adequate temperature difference between the pressure-reduced further enriched liquid air stream which is heat exchanged with the argon-rich vapour and the argon-rich vapour itself. It is within the scope of the invention partially to reboil only a part of the oxygen-enriched liquid air stream and to employ another part to condense the argon-rich vapour. It is also within the scope of the invention to employ a single stream of pressure-reduced, further-enriched, liquid to condense both the oxygen-depleted vapour and the argon-rich vapour. The condensation of the further-enriched vapour may in such examples be performed either upstream or downstream of the condensation of the argon vapour. In accordance with the invention, vapour of the further-enriched liquid formed in the condensation of the oxygen-depleted vapour or the argon-rich vapour, or both, forms the vaporous oxygen-enriched air that is introduced into the lower pressure rectification column through the said inlet.

The process and plant according to the present invention are particularly suitable for use if the double rectification column is of the kind that has a condenser-reboiler associated with it for condensing nitrogen vapour separated in the higher pressure column by indirect heat exchange of oxygen-rich liquid separated in the lower pressure rectification column. The condenser-reboiler is thus able to provide reflux for both the higher pressure rectification column and the lower pressure rectification column. In the process and plant according to the present invention, the lower pressure rectification column is preferably operated with a pressure at its top in the range of 1.2 to 1.5 bar.

The process and plant according to the invention may have other conventional features. For example, a flow of compressed air for separation is preferably purified by adsorption to remove low volatility impurities, particularly water vapour and carbon dioxide therefrom. A first stream of compressed, purified, air in vapour state and a second stream of compressed, purified, air in liquid state are typically introduced into the higher pressure rectification column. If desired, a third stream of compressed, purified, air in liquid state may be introduced into the lower pressure rectification column, and, in examples in which the separation of the further-enriched liquid from the oxygen-depleted vapour is conducted in a rectification column, a fourth stream of compressed, purified, air may be introduced in liquid state into this further rectification column. It is also within the scope of the process and plant according to the invention to introduce a fifth stream of purified air in vaporous state from an expansion turbine into the lower pressure rectification column.

The process and plant according to the invention may be employed to produce just gaseous oxygen and nitrogen products, or may produce some of the oxygen and nitrogen products in liquid state.

If a gaseous oxygen product is to be produced, it may be withdrawn as vapour from the lower pressure rectification column or may be taken as a liquid and vaporised at an elevated pressure. If liquid oxygen and nitrogen products are required, or if it is required to produce an oxygen product in gaseous state by withdrawing liquid oxygen from the lower pressure rectification column, pressurising it and vaporising it, there is typically a need to produce liquid air and to utilise one or more of the second, third and fourth streams of compressed, purified, air. The advantages offered by the process and plant of the present invention tend to be more marked when such liquid air is produced.

The refrigeration requirements of the plant and process according to the present invention are typically met by expanding either compressed, purified, air or an elevated pressure nitrogen stream in one or more expansion turbines.

The air streams are preferably converted to vapour or liquid state by indirect heat exchange with streams taken from the lower pressure rectification column.

BRIEF DESCRIPTION OF THE DRAWINGS

The process and plant according to the present invention will now be described by way of example with reference to the accompanying drawings, in which.

The drawings are not to scale.

DETAILED DESCRIPTION

Figure 1:
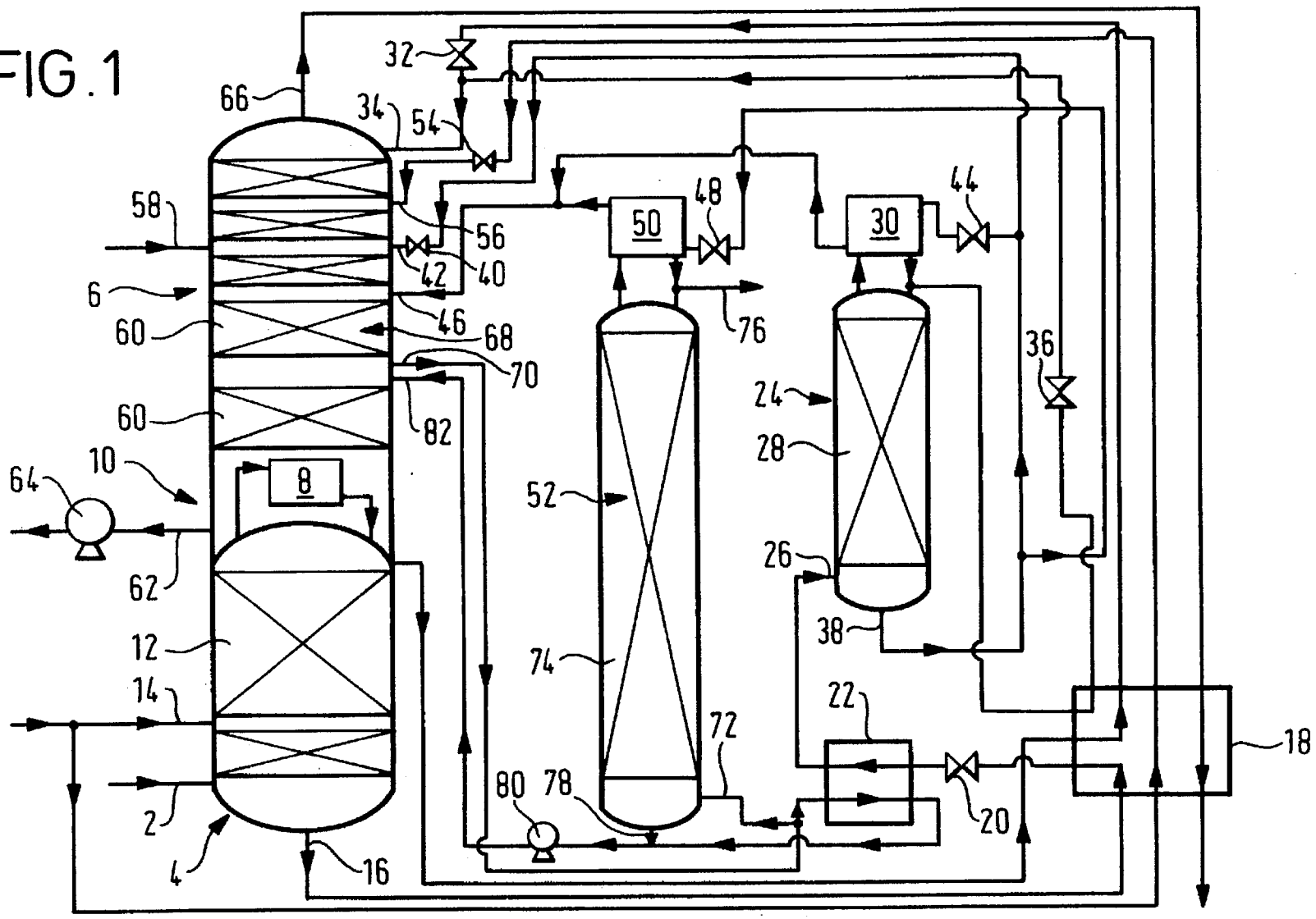
FIG. 1 is a schematic flow diagram of an arrangement of rectification columns forming part of an air separation plant.

Referring to FIG. 1 of the drawings, a first stream of vaporous air is introduced through an inlet 2 into a bottom region of a higher pressure rectification column 4 which is thermally linked to a lower pressure rectification column 6 by a condenser-reboiler 8. Together, the higher pressure rectification column 4 and the lower pressure rectification column 6 constitute a double rectification column 10. The higher pressure rectification column 4 contains liquid-vapour contact devices 12 in the form of plates, trays or packings. The devices 12 enable an ascending vapour phase to come into intimate contact with a descending liquid phase such that mass transfer takes place between the two phases. Thus, the ascending vapour is progressively enriched in nitrogen, the most volatile of the three main components (nitrogen, oxygen and argon) of the purified air and the descending liquid is progressively enriched in oxygen which is the least volatile of these three components. A second compressed, purified, air stream is introduced into the higher pressure rectification column 4 in liquid state through an inlet 14 which is typically located at a level such that the number of trays or plates or the height of packing therebelow corresponds to a few theoretical trays (for example, about 5).

A sufficient height of packing or a sufficient number of trays or plates is included in the higher pressure rectification column 4 that an essentially pure nitrogen vapour flows out of the top of the column 4 into the condenser-reboiler 8 where it is condensed.

A part of the resulting condensate is returned to the higher pressure rectification column 4 as reflux. An oxygen-enriched liquid (typically containing about 38% by volume of oxygen) is withdrawn from the bottom of the higher pressure rectification column 14 through an outlet 16. The oxygen-enriched liquid air stream is sub-cooled by passage through a part of a heat exchanger 18. The sub-cooled, oxygen-enriched, liquid air stream is reduced in pressure by passage through a throttling valve 20. The resulting pressure-reduced liquid stream is partially reboiled by passage through reboiling passages of a reboiler 22. Since nitrogen is more volatile than oxygen, the partial reboiling causes the formation of an oxygen-depleted vapour and a liquid further-enriched in oxygen vapour. The resulting mixture of liquid further enriched in oxygen and the oxygen-depleted vapour flows into a further rectification column 24 through an inlet 26. The rectification column 24 includes liquid-vapour contact devices 28 causing intimate contact between an ascending vapour phase and a descending liquid phase with the result that mass transfer takes place between the ascending vapour and descending liquid. Accordingly, there is a further depletion of the oxygen content of the vapour phase as it ascends the rectification column 24. A sufficient height of packing or a sufficient number of trays or plates is generally included in the further rectification column 24 for the vapour at the top of the column to be essentially pure nitrogen. This vapour flows into a condenser 30 where it is condensed. A part of the resulting condensate is employed as reflux in the further rectification column 24.

A stream of the condensate formed in the condenser-reboiler 8 is sub-cooled by passage through a part of the heat exchanger 18, is reduced in pressure by passage through a throttling valve 32, and is introduced into the top of the lower pressure rectification column 6 through an inlet 34. A stream of nitrogen condensate is taken from the condenser 30, is sub-cooled by passage through a part of the heat exchanger 18, and is reduced in pressure by passage through a throttling valve 36. The resulting pressure-reduced liquid nitrogen is mixed with that introduced into the lower pressure rectification column 6 through the inlet 34, the mixing taking place downstream of the throttling valve 32. The liquid nitrogen introduced into the lower pressure rectification column 6 through the inlet 34 provides reflux for the column 6.

A stream of liquid air, further enriched in oxygen, ("further enriched liquid air") is withdrawn from the bottom of the further rectification column 24 through an outlet 38. The further-enriched liquid air stream (containing about 40% by volume of oxygen) is divided into three subsidiary streams. (Although not shown in FIG. 1, the stream of further-enriched liquid air may, if desired, be sub-cooled upstream of its division into the three subsidiary streams.) One of the subsidiary streams flows through a throttling valve 40 and is introduced into the lower pressure rectification column 6 through an inlet 42 at an intermediate level thereof. A second subsidiary stream of the further-enriched liquid is passed through a throttling valve 44 in order to reduce its pressure to a little above that of the lower pressure rectification column 6 and is passed through the condenser 30 so as to provide the necessary cooling for the condensation of the nitrogen vapour therein. The second further-enriched liquid air stream is thereby either partially or totally vaporised. The resulting fluid flows into the lower pressure rectification column 6 through another intermediate inlet 44 at a level below that of the inlet 42. The third subsidiary stream of further-enriched liquid is reduced in pressure to a little above the operating pressure of the lower pressure rectification column 6 by passage through a throttling valve 48. The pressure reduced, third subsidiary stream of further enriched liquid oxygen is employed to provide cooling for a condenser 50 associated with the top of a side column 52 in which argon is separated. The operation of the side column 52 shall be described below. The pressure-reduced stream of the further enriched liquid air is thereby vaporised and the resulting vapour is merged with the vaporised second subsidiary stream of further enriched liquid air upstream of its introduction into the rectification column 6 through the inlet 46.

If desired, a third stream of compressed, purified, air in liquid state may be sub-cooled by passage through the heat exchanger 18, reduced in pressure to the operating pressure of the lower pressure rectification column 6 by passage through a throttling valve 54, and introduced into the column 6 through another intermediate inlet 56 at a level above that of the inlet 42. Although not shown in FIG. 1, it is also possible to sub-cool a fourth stream of compressed, purified, air in the heat exchanger 18, to reduce the pressure of that stream to the operating pressure of the further rectification column 24 and to introduce it into the column 24 at an intermediate mass-exchange level thereof. In further examples of the operation of the plant shown in FIG. 1 of the drawings, a fifth stream of compressed, purified, air, in vapour state, may be introduced into the lower pressure rectification column 6 through an inlet 58 typically, but not necessarily, at the same level as the inlet 56.

The various streams of air introduced into the lower pressure rectification column 6 are separated therein to form at the bottom of the column 6 an oxygen product preferably containing less than 0.5% by volume of impurities (more preferably less than 0.1% by volume of impurities) and a nitrogen product at its top containing less than 0.1% by volume of impurities. The separation is effected by contact of an ascending vapour phase with descending liquid on liquid-vapour contact devices 60, which are preferably packing (particularly structured packing), but which alternatively can be provided by trays or plates. The ascending vapour is created by the condensing nitrogen in the reboiler-condenser 8 boiling liquid oxygen at the bottom of the lower pressure rectification column 6. An oxygen product in liquid state is withdrawn from the bottom of the rectification column 6 through an outlet 62 by a pump 64. Additionally or alternatively, the oxygen product may be withdrawn in vapour state through another outlet (not shown). A nitrogen product is withdrawn from the top of the rectification column 6 through an outlet 66 and is passed through the heat exchanger 18 in countercurrent heat exchange with the streams being sub-cooled.

A local maximum of argon is created in a section 68 of the lower pressure rectification column 6 extending from an intermediate outlet 70 to the intermediate inlet 46. An argon-enriched vapour stream is withdrawn through the outlet 70 and is divided into two subsidiary streams. One subsidiary stream is fed into the bottom of the side rectification column 52 through an inlet 72. The other subsidiary stream of argon-enriched vapour undergoes indirect heat exchange with the pressure-reduced, oxygen-enriched, liquid air stream in the reboiler 22, thereby effecting the partial reboiling of the liquid air, and is itself condensed. If desired, instead of taking the argon-enriched vapour stream for use in the reboiler 22 from the outlet 70 at the bottom of the section 68 of the lower pressure rectification column 6, an argon-enriched stream, in vapour state, may be taken from an intermediate region of the section.

The argon-enriched oxygen vapour that is introduced into the bottom of the rectification column 52 through the inlet 72 has an argon product separated therefrom. The column 52 contains liquid-vapour contact devices 74 in order to effect intimate contact, and hence mass transfer, between ascending vapour phase and a descending liquid phase. The descending liquid phase is created by operation of the condenser 50 to condense argon taken from the top of the column. A part of the condensate is returned to the top of the column 52 as reflux; another part is withdrawn through an outlet 76 as liquid argon product. If the argon product contains more than 1% by volume of oxygen, the liquid-vapour contact elements 74 may comprise either packing, typically a low pressure drop structured packing, or trays or plates in order to effect the separation. If, however, the argon is required to have a lower concentration of oxygen, low pressure drop packing is usually employed so as to ensure that the pressure at the top of the argon column is such that the condensing temperature of the argon exceeds the temperature of the fluid which is used to cool the condenser 50.

An impure liquid oxygen stream is withdrawn from the bottom of the side rectification column 52 through an outlet 78 and is passed by a pump 80 through an inlet 82 to the same region of the rectification column 6 as that from which the argon-enriched oxygen vapour stream is withdrawn through the outlet 70.

Figure 2:
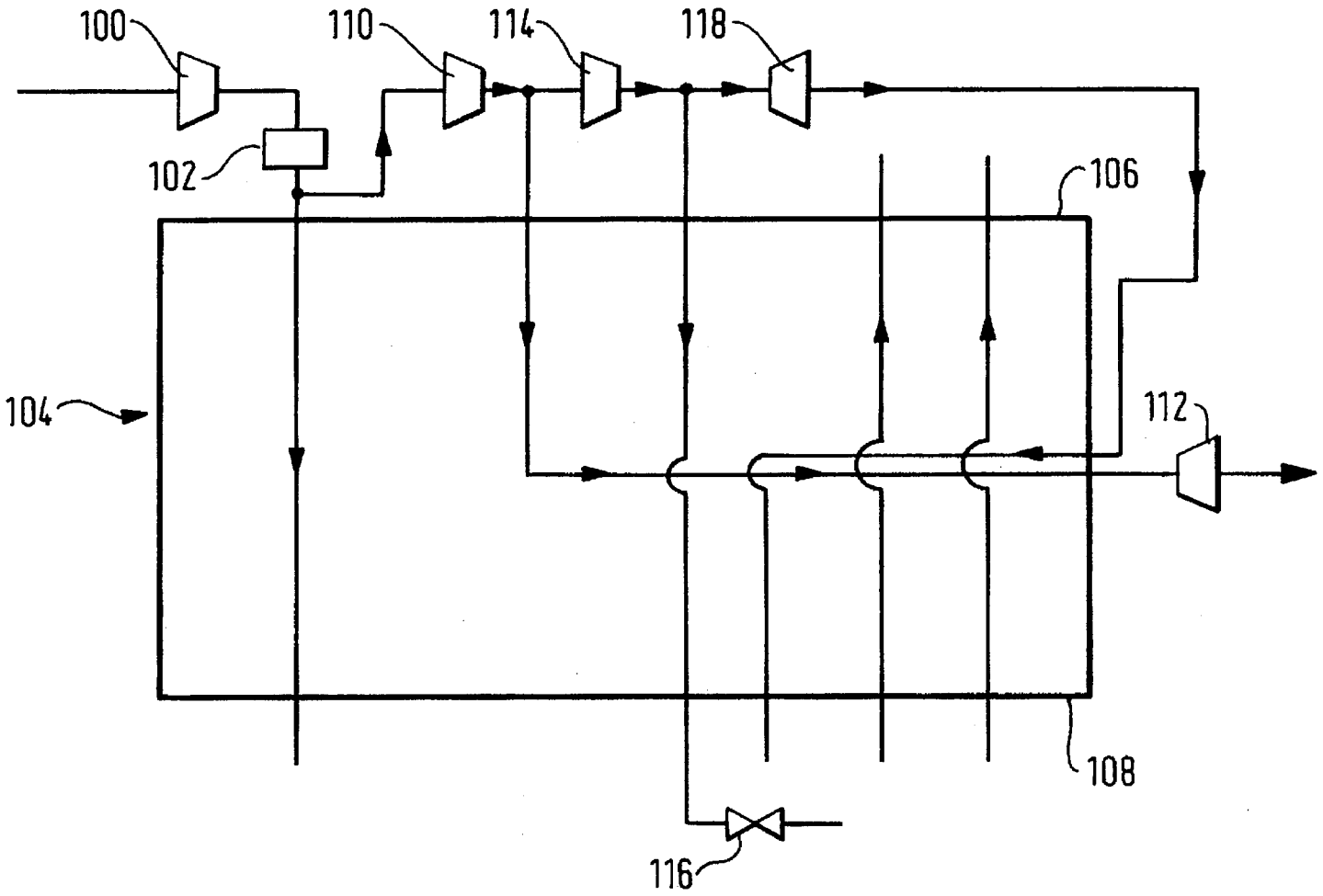
FIG. 2 is a schematic flow diagram of a heat exchanger and associated apparatus for producing the feed streams to that part of the air separation plant which is shown in FIG. 1.

In a typical example of the operation of the part of the plant shown in FIG. 1, the lower pressure rectification column 6 operates at a pressure of about 1.3 bar at its top and the higher pressure rectification column 4 operates at a pressure of about 5.2 bar at its top; the side rectification column 52 operates at a pressure of approximately 1.2 bar at its top, and the further rectification column 24 operates at a pressure of approximately 2.9 bar at its top. Referring now to FIG. 2 of the accompanying drawings, there is shown another part of the air separation plant in which the air streams employed in the part of the plant shown in FIG. 1 are formed. Referring to FIG. 2, an air stream is compressed in a first compressor 100. The compressor 100 has a water cooler (not shown) associated therewith so as to remove the heat of compression from the compressed air. Downstream of the compressor 100 the air stream is passed through a purification unit 102 effective to remove water vapour and carbon dioxide therefrom. The unit 102 employs beds (not shown) of adsorbent to effect this removal of water vapour and carbon dioxide. The beds are operated out of sequence of one another such that while one or more beds are purifying the compressed air stream, the remainder are able to be regenerated, for example, by being purged by a stream of hot nitrogen. Such purification units and their operation are well known in the art and need not be described further.

The purified air stream is divided into two subsidiary streams. A first subsidiary stream of purified air flows through a main heat exchanger 104 from its warm end 106 to its cold end 108 and is cooled to approximately its dew point. The resulting cooled air stream forms a part of the first air stream which is introduced into the higher pressure rectification column 4 through the inlet 2 in that part of the plant which is shown in FIG. 1.

Referring again to FIG. 2, the second subsidiary stream of purified compressed air is further compressed in a compressor 110 having a water cooler associated therewith to remove the heat of compression. The further compressed air stream is divided into two parts. One part is cooled by passage through the main heat exchanger 104 from its warm end 106 to an intermediate region thereof and is withdrawn therefrom. This cooled, further compressed, stream of air is expanded with the performance of work in an expansion turbine 112 and forms the fifth air stream which is introduced into the lower pressure rectification column 6 through the inlet 58 in that part of the plant which is shown in FIG. 1. Referring again to FIG. 2, the second part of the compressed air stream taken from the compressor 110 is further compressed in a compressor 114 which has a water cooler associated therewith to remove heat of compression. This further compressed air stream is itself divided into two subsidiary streams. One subsidiary stream flows through the main heat exchanger 104 from its warm end 106 to its cold end 108. The resulting stream of further compressed air is passed through a throttling valve 116 and the resultant liquid air stream is used to form the second, third and fourth air streams described with reference to FIG. 1 of the drawings.

Referring again to FIG. 2, the second subsidiary stream of the air further compressed in the compressor 114 is expanded in a second expansion turbine 118. The resulting expanded air stream is introduced into the main heat exchanger 104 at an intermediate heat exchange region thereof and flows therefrom to the cold end 108 of the heat exchanger 104. The resulting air stream forms the rest of the first air stream described with reference to FIG. 1.

The liquid oxygen stream pressurised in that part of the plant which is shown in FIG. 1 by the pump 64 flows through the main heat exchanger 104 countercurrently to the air stream and is vaporised by indirect heat exchange with the air stream. In addition, the nitrogen product stream is taken from the heat exchanger 18 of that part of the plant which is shown in FIG. 1 and is warmed to ambient temperature by passage through the heat exchanger 104 by countercurrent heat exchange with the air stream.

Figure 3:
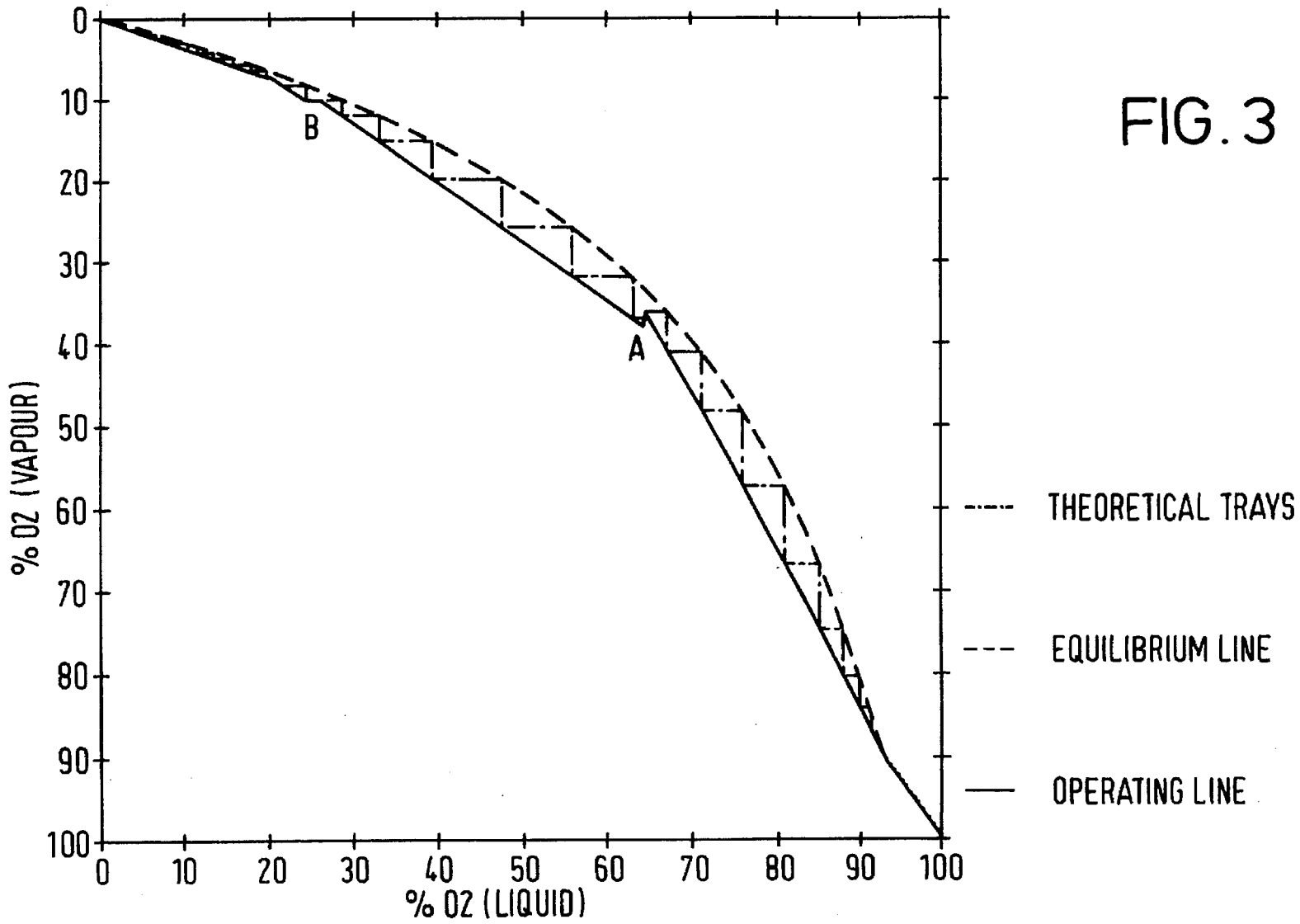
FIG. 3 is a schematic McCabe-Thiele diagram illustrating operation of the lower pressure rectification in one example of a process according to the invention.

FIG. 3 is a McCabe-Thiele diagram illustrating the operation of the lower pressure rectification column 6 shown in FIG. 1. In this example, the pressures at which the respective rectification columns are operated is as described above with reference to FIG. 1. No third and fourth air streams are supplied. The ratio of the flow rate of the first air stream to that of the second air stream is 1.7:1.

Figure 4:
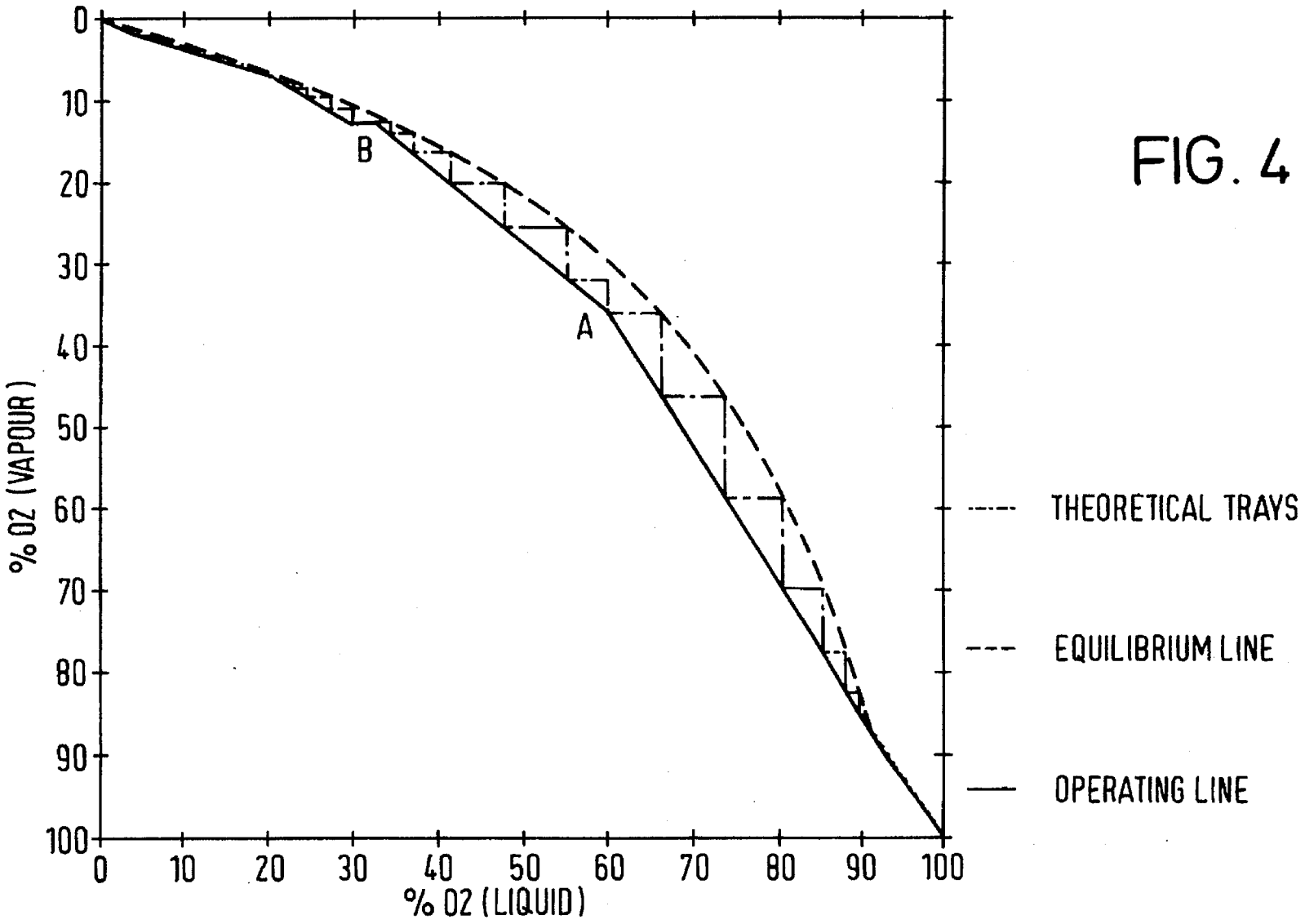
FIG. 4 is a similar McCabe-Thiele diagram illustrating operation of the lower pressure rectification column in a comparable conventional plant.

FIG. 4 is a McCabe-Thiele diagram illustrating operation of the lower pressure rectification column of a comparable conventional plant. The ratio of the flow rate of the first air stream to that of the second air stream in the conventional plant is the same as that in the plant which is illustrated by FIG. 3. In the conventional plant, no further rectification column 24 is employed and a part of the oxygen-enriched liquid air is used to condense the argon column. The resulting vaporised oxygen-enriched liquid air is fed to the lower pressure rectification column. The operation of the side rectification column causes the operating line in the McCabe-Thiele diagram shown in FIG. 4 to be relatively distant from the equilibrium line in the section AB of the lower pressure rectification column (i.e. the section extending from the Point A at which the argon-enriched oxygen vapour is withdrawn to the Point B at which the oxygen-enriched vapour is introduced). Similarly, the operating line in FIG. 4 is relatively distant from the equilibrium line below the point A as well as above the point A.

Referring now to FIG. 3, the passage of part of the condensed oxygen-depleted vapour from the condenser 30 to the lower pressure rectification column 6 increases the reflux ratio in the corresponding section AB of the rectification column 6. As a result, the line AB in FIG. 3 is closer to the equilibrium line than it is in FIG. 4. Also, part of the operating line below the point A is similarly moved closer to the equilibrium line. As a result, it is desirable to employ a few more theoretical plates in the section AB of the tower pressure rectification column whose operation is illustrated in FIG. 3 than in the lower pressure rectification column illustrated in FIG. 4. Similarly, it is also desirable to employ a few more theoretical plates in the section below the point A in the rectification column whose operation is illustrated in FIG. 3. It is also noticeable from the two diagrams that the process based on FIG. 3 has a more favourable reflux ratio in the top section of the lower pressure rectification column. The enhanced reflux conditions make possible either an increase in argon and oxygen recoveries, or a power saving, or a combination of both advantages.

Typically, the argon recovery can be improved by more than 10%, for example from 80% to 90%. If the benefit is taken as a power saving, the proportion of the feed air that is introduced into the lower pressure rectification column 6 through the inlet 58 can be increased by about 6%, representing a saving of about 4.5% of the power consumed by the main air compressor.

In general, the maximum advantage made possible by the process according to the invention is obtained when the condenser-reboiler 8 is of the thermosiphon kind rather than the downflow reboiling kind and when the pressure at the inlet to the argon column is the same as and not lower than the pressure at which the argon-enriched oxygen vapour is taken from the lower pressure rectification column.

Figure 5:
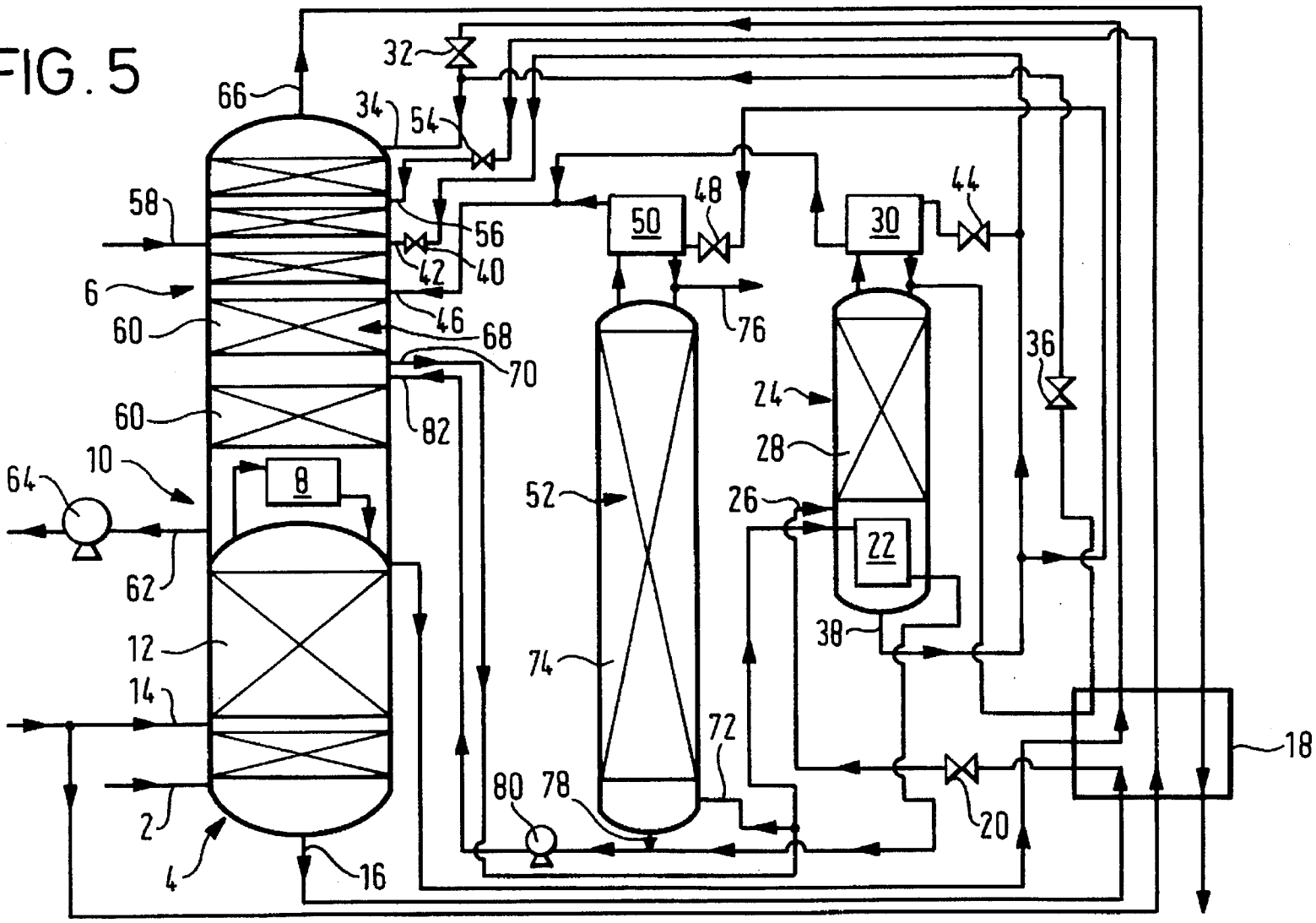
FIG. 5 is a schematic flow diagram of an alternative arrangement of rectification columns forming part of an air separation plant.

Various changes and modifications, as set out below, may be made to the plant shown in FIGS. 1 and 2. Preferably, the air fed to the expansion turbine 118 is pre-chilled in the main heat exchanger 104 such that this air enters the turbine 118 at below ambient temperature. The entire oxygen product of the plant may be withdrawn by the pump 64, which in this case is not a pressurising pump, sub-cooled and fed to a storage tank (not shown). The gaseous oxygen product may be formed by withdrawing one or more streams from the liquid oxygen storage tank, pressurising the streams, and vaporising the streams in the main heat exchanger. For example, a first gaseous oxygen product may be produced at a pressure in the range of 10 to 15 bar and a second oxygen product at a pressure in the range of 35 to 40 bar. Accordingly, two air streams may be liquefied at different pressures, the pressures being selected so as to enable the main heat exchanger 104 to be operated efficiently. The entire flow or flows of liquid air may be fed to the higher pressure rectification column 4 and a liquid stream of similar composition to the liquid air may be withdrawn from the same level of the higher pressure rectification column 4. A part of this liquid stream may be fed to the lower pressure rectification column 6. The remainder may be partially vaporised by indirect heat exchange with the liquid oxygen being sub-cooled in a reboiler (not shown) separate from the main heat exchanger 104. Resulting liquid and vaporous air may be passed into the lower pressure rectification column 6. In order to maximise argon recovery, no fifth air stream need be employed and hence the inlet 58 to the lower pressure rectification column 6 can be omitted. In consequence, both the expansion turbines may be arranged to produce expanded air streams at the same pressure as the first air stream, and both these expanded air streams may be mixed with the first air stream immediately upstream of the inlet 2 to the higher pressure rectification column 4. In addition, some or all of the liquid air fed to the higher pressure rectification column 4 may be expanded in a further expansion turbine (not shown) which may have an oil brake (not shown) associated therewith, instead of being expanded by passage through the valve 116. Further, in order to enable a liquid product to be taken from the liquid oxygen storage tank (not shown) at a variable rate, the plant may have a facility for returning a part or all of one or both of the expanded air streams via the main heat exchanger 104 to the inlet of the compressor 110 at a selected rate. Valves (not shown) may be provided for this purpose and may be operable to select that proportion of the turbine-expanded air which is introduced into the higher pressure rectification column 4 and that proportion which is returned to the inlet of the compressor 110. Moreover, the reboiler 22 may be located in the sump of the rectification column 24 as illustrated in FIG. 5 of the drawings. As shown in FIG. 5 the oxygen-enriched fluid stream flows from the valve 20 directly to the inlet 26 of the further rectification column 24.

Figure 6:
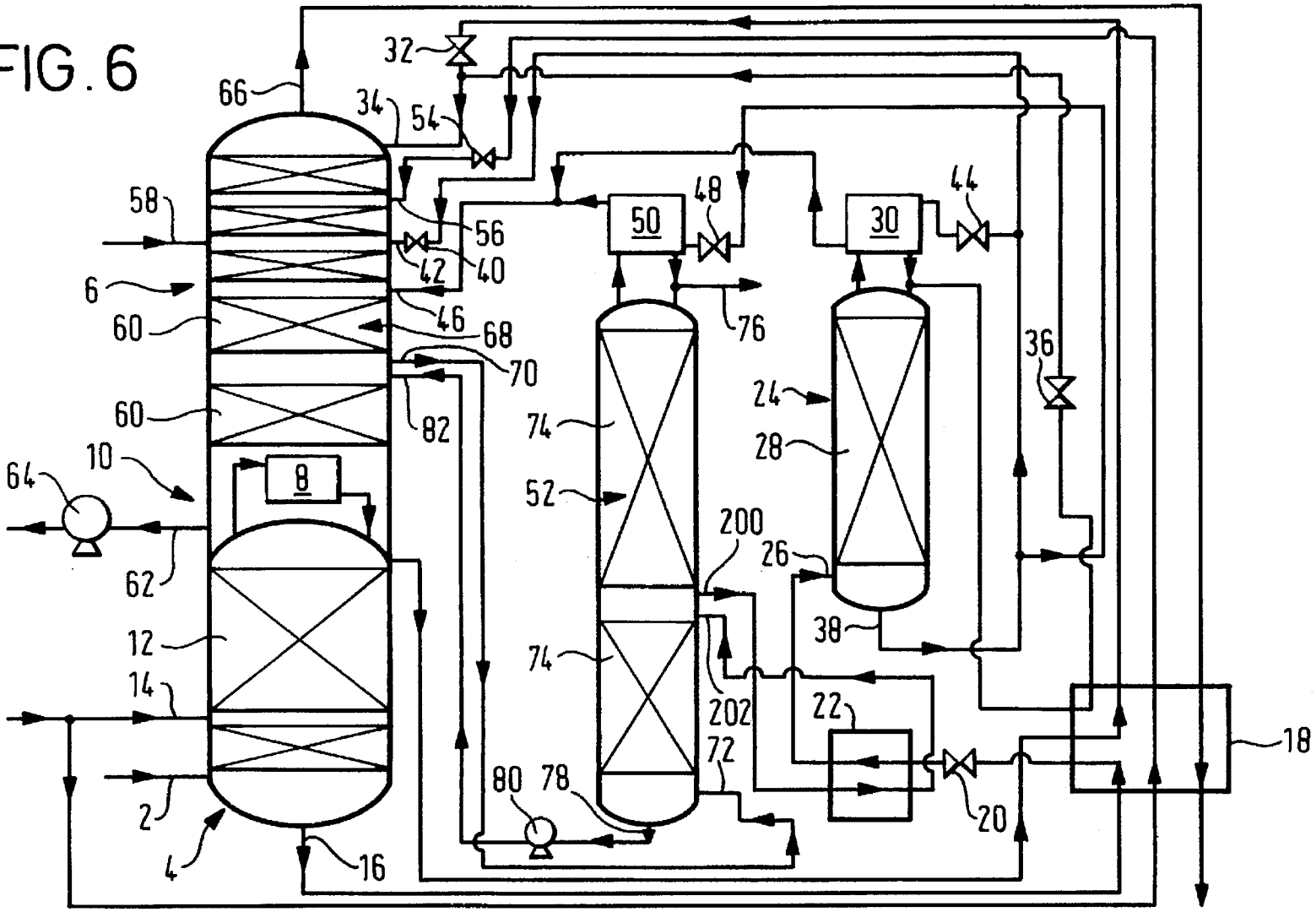
FIG. 6 is a schematic flow diagram of a further alternative arrangement of rectification columns forming part of an air separation plant.

In FIG. 6, there is shown a modification in which the side rectification column 52 has two sections of packing 74 and the stream for heating the reboiler 22 is taken via an outlet 200 from an intermediate region of the column 52 between the two sections. The stream is condensed by indirect heat exchange in the reboiler 22 with boiling oxygen-enriched liquid. The resulting condensate is returned to the side distillation column 52 via an inlet 202 at generally the same level as the outlet 200.

The column arrangements shown in FIGS. 5 and 6 typically offer essentially the same advantages as that shown in FIG. 1.

We claim:

1. An air separation process including:

separating a flow of compressed air into an oxygen-rich fraction and a nitrogen-rich fraction within a double rectification column having higher and lower pressure rectification columns;

withdrawing an argon-enriched oxygen vapour stream from an intermediate outlet of the lower pressure rectification column and separing an argon fraction from said argon-enriched oxygen vapour stream within a side rectification column;

taking an oxygen-enriched liquid air stream from the higher pressure rectification column;

introducing a vaporous oxygen-enriched air stream into the lower pressure rectification column through an inlet above the said intermediate outlet;

partially reboiling and separating at least part of said oxygen-enriched liquid air stream at a pressure between pressures at the bottom of the higher pressure rectification column and the said inlet to the lower pressure rectification column, thereby to form a liquid air stream further enriched in oxygen and a vapour depleted of oxygen;

said partial reboiling being effected by indirect exchange with a stream of vapour withdrawn from a section of the lower pressure rectification column extending from said intermediate outlet;

at least one stream of the further enriched liquid being vaporised so as to form part or all of the said vaporous oxygen-enriched air stream;

condensing a flow of the oxygen-depleted vapour; and introducing at least part of the condensed oxygen-depleted vapour into the lower pressure rectification column or is taking said at least part of the condensed oxygen-depleted vapour as product.

2. The process as claimed in claim 1, in which the oxygen-enriched liquid air stream is sub-cooled upstream of its heat exchange with the stream of vapour withdrawn from said section of the lower pressure rectification column.

3. The process as claimed in claim 1, in which the oxygen-enriched liquid air stream is partially reboiled upstream of a vessel in which the separation of the further-enriched liquid from the oxygen-depleted vapour is performed.

4. The process as claimed in claim 1, in which the partial reboiling of the said oxygen-enriched liquid air is performed in a vessel the same as that in which the separation of the said oxygen-enriched liquid air is performed.

5. The process as claimed in claim 1, in which the partially reboiled oxygen-enriched liquid air stream is separated by rectification.

6. The process as claimed in claim 5, in which the oxygen-depleted vapour is nitrogen.

7. The process as claimed in claim 1, in which a stream of the further-enriched liquid is reduced in pressure and is indirectly heat exchanged with the oxygen-depleted vapour so as to condense that vapour and so as to form at least part of the said vaporous oxygen-enriched air stream.

8. The process as claimed in claim 1, in which a stream of the further-enriched liquid is reduced in pressure and is indirectly heat-exchanged with the argon fraction so as to condense the argon vapour and so as to form at least part of the said vaporous oxygen-enriched air stream.

9. The process as claimed in claim 1, in which a part of the incoming air is liquefied upstream of its introduction into the double rectification column.

10. An air separation process including:

separating a flow of compressed air into an oxygen-rich fraction and a nitrogen-rich fraction within a double rectification column having higher and lower pressure rectification columns;

withdrawing an argon-enriched oxygen vapour stream from an intermediate outlet of the lower pressure rectification column and separing an argon fraction from said argon-enriched oxygen vapour stream within a side rectification column;

taking an oxygen-enriched liquid air stream from the higher pressure rectification column;

introducing a vaporous oxygen-enriched air stream into the lower pressure rectification column through an inlet above the said intermediate outlet;

partially reboiling and separating at least part of said oxygen-enriched liquid air stream at a pressure between pressures at the bottom of the higher pressure rectification column and at the said inlet to the lower pressure rectification column, thereby to form a liquid further enriched in oxygen and a vapour depleted of oxygen;

said partial reboiling being effected by indirect exchange with a stream of vapour withdrawn from an intermediate region of the side rectification column;

vaporizing at least one stream of the further enriched liquid so as to form part or all of the said vaporous oxygen-enriched air stream;

condensing a flow of the oxygen-depleted vapour by indirect heat exchange with a stream of the further enriched liquid; and introducing at least part of the condensed oxygen-depleted vapour into the lower pressure rectification column or is taking said at least part of the condensed oxygen-depleted vapour as product.

11. The process as claimed in claim 10, in which the oxygen-enriched liquid air stream is sub-cooled upstream of its heat exchange with the stream of vapour withdrawn from said section of the lower pressure rectification column.

12. The process as claimed in claim 10, in which the oxygen-enriched liquid air stream is partially reboiled upstream of the vessel in which the separation of the further-enriched liquid from the oxygen-depleted vapour is performed.

13. The process as claimed in claim 10, in which the partial reboiling of the said oxygen-enriched liquid air is performed in a vessel the same as that in which the separation of the said oxygen-enriched liquid air is performed.

14. The process as claimed in claim 10, in which the partially reboiled oxygen-enriched liquid air stream is separated by rectification.

15. The process as claimed in claim 14, in which the oxygen-depleted vapour is nitrogen.

16. The process as claimed in claim 10, in which a stream of the further-enriched liquid is reduced in pressure and is indirectly heat exchanged with the oxygen-depleted vapour so as to condense that vapour and so as to form at least part of the said vaporous oxygen-enriched air stream.

17. The process as claimed in claim 10, in which a stream of the further-enriched liquid is reduced in pressure and is indirectly heat exchanged with the argon fraction so as to condense the argon vapour and so as to form at least part of the said vaporous oxygen-enriched air stream.

18. An air separation plant including:

a double rectification column comprising a higher pressure rectification column and a lower pressure rectification column for separating a flow of compressed air into an oxygen-rich fraction and a nitrogen-rich fraction;

a side rectification column for separating an argon-enriched oxygen vapour stream withdrawn from an intermediate outlet of the lower pressure rectification column;

the higher pressure rectification column having an outlet for an oxygen-enriched liquid air stream and the lower pressure rectification column having an inlet for an oxygen-enriched vaporous air stream above said intermediate outlet;

a reboiler for partially reboiling and a vessel for separating at least part of said oxygen-enriched liquid air stream at a pressure between pressures at the bottom of the higher pressure rectification and the said inlet to the lower pressure rectification column to form a liquid air stream further enriched in oxygen and a vapour depleted of oxygen;

a heat exchanger for vaporising a stream of the further enriched liquid air so as to form a part or all of the vaporous oxygen-enriched air feed to the lower pressure rectification column; and a condenser for condensing a stream of the oxygen-depleted vapour having an outlet for condensate communicating with a further inlet to the lower pressure rectification column, or with a product collection vessel;

the reboiler having heat exchange passages communicating with an outlet from a section of the lower pressure rectification column extending from said intermediate inlet to said outlet for the argon-enriched oxygen vapour.

19. An air separation plant including:

a double rectification column comprising a higher pressure rectification column and a lower pressure rectification column for separating a flow of compressed air into an oxygen-rich fraction and a nitrogen-rich fraction;

a side rectification column for separating an argon-enriched oxygen vapour stream withdrawn from an intermediate outlet of the lower pressure rectification column;

the higher pressure rectification column having an outlet for an oxygen-enriched liquid air stream and the lower pressure rectification column having an inlet for an oxygen-enriched vaporous air stream above said intermediate outlet;

a reboiler for partially reboiling and a vessel for separating at least part of said oxygen-enriched liquid air stream at a pressure between pressures at the bottom of the higher pressure rectification and at the said inlet to the lower pressure rectification column to form a liquid air stream further enriched in oxygen and a vapour depleted of oxygen;

a heat exchanger for vaporising a stream of the further enriched liquid air so as to form a part or all of the vaporous oxygen-enriched air feed to the lower pressure rectification column; and a condenser for condensing a stream of the oxygen-depleted vapour having an outlet for condensate communicating with a further inlet to the lower pressure rectification column, or with a product collection vessel;

the condenser having heat exchange passages for the flow therethrough of a stream of the further enriched liquid;

the reboiler having heat exchange passages communicating with an outlet from an intermediate region of the side rectification column.

20. The air separation plant according to claim 18 or claim 19, in which the said reboiler is located upstream of said vessel.

21. The air separation plant according to claim 18 or claim 19, in which the said reboiler is located in said vessel.

22. The air separation plant according to claim 18 or claim 19, wherein said heat exchange passages of the reboiler also communicate with an inlet to the same location as that from which leads the outlet communicating with the said heat exchange passages.

* * * * *